US006942066B1

(12) United States Patent
Miyoshi et al.

(10) Patent No.: US 6,942,066 B1
(45) Date of Patent: Sep. 13, 2005

(54) ELEVATOR APPARATUS

(75) Inventors: Hiroyuki Miyoshi, Mie (JP); Takashi Kuga, Mie (JP)

(73) Assignee: TS Corporation, Tokyo (JP)

( * ) Notice: Subject to any disclaimer, the term of this patent is extended or adjusted under 35 U.S.C. 154(b) by 0 days.

(21) Appl. No.: 09/629,276

(22) Filed: Jul. 31, 2000

(30) Foreign Application Priority Data

Aug. 30, 1999 (JP) ..... 11-219488

(51) Int. Cl.[7] ..... B66B 11/08

(52) U.S. Cl. ..... 187/254; 187/289; 254/342; 310/83

(58) Field of Search ..... 187/254, 289; 254/342; 310/83

(56) References Cited

U.S. PATENT DOCUMENTS

| | | | | | |
|---|---|---|---|---|---|
| 4,013,142 | A | * | 3/1977 | Hagg | 187/254 |
| 4,526,252 | A | * | 7/1985 | Hirano | 187/20 |
| 4,923,055 | A | * | 5/1990 | Holland | 187/109 |
| 5,010,981 | A | * | 4/1991 | Heikkinen | 254/342 |
| 5,353,894 | A | * | 10/1994 | Garrido et al. | 187/254 |
| 5,435,209 | A | * | 7/1995 | Wittur | 74/606 R |
| 5,469,937 | A | * | 11/1995 | Hakala et al. | 187/266 |
| 5,615,864 | A | * | 4/1997 | Liebetrau et al. | 187/254 |
| 5,644,111 | A | * | 7/1997 | Cerny et al. | 187/393 |
| 5,792,294 | A | * | 8/1998 | Randazzo et al. | 156/94 |
| 5,873,434 | A | * | 2/1999 | Sugita et al. | 187/288 |
| 6,107,714 | A | * | 8/2000 | Fischer | 310/77 |
| 6,202,793 | B1 | * | 3/2001 | Fargo | 187/277 |
| 6,230,844 | B1 | * | 5/2001 | Latorre | 187/254 |

FOREIGN PATENT DOCUMENTS

| | | | | |
|---|---|---|---|---|
| DE | 38 40 281 | * | 5/1990 | |
| EP | 0 646 537 | A1 | 4/1995 | |
| EP | 0 834 463 | A1 | 4/1998 | |
| EP | 0 841 283 | A1 | 5/1998 | |
| JP | 54-20547 | * | 2/1979 | 187/414 |
| JP | 7-97157 | * | 4/1995 | |
| JP | 07-133849 | | 5/1995 | |
| JP | A-2-62394 | | 3/1999 | |
| JP | 11-079627 | | 3/1999 | |
| JP | 8-285197 | * | 11/1999 | |

* cited by examiner

*Primary Examiner*—Thomas J. Brahan
(74) *Attorney, Agent, or Firm*—Akin Gump Strauss Hauer & Feld, LLC

(57) ABSTRACT

A height of a case body (54) for covering an actuating device (1) is so designed as to be lower than a height of an operator. The actuating device (1) and the case body (54) will not largely project from a rooftop (50) of the building in which an ascending and descending cage (52) is disposed, and cost for the case body (54) can be lowered.

6 Claims, 2 Drawing Sheets

ELEVATOR APPARATUS

BACKGROUND OF THE INVENTION

The present invention relates to an elevator apparatus for moving an ascending and descending cage of an elevator upward and downward.

Recently, comparatively tall buildings relative to areas of grounds have been often built, because there are many cases where the grounds are limited in a city and the like. In such a tall building, an elevator is particularly required to ascend to high floors, and it is a problem how this elevator should be installed. Although an elevator passage through which the ascending and descending cage of the elevator passes must be provided in a manner passing through respective floors, an actuating device for moving the elevator upward and downward can be installed at an optional position to some degree.

As disclosed in Japanese Publication of unexamined Patent Application No. JP-A-2-62394, in case where a machine room is provided on a rooftop of the building in which the elevator passage is arranged, and the actuating device for the elevator is disposed in the machine room, spaces on the respective floors can be saved for effective use. However, it is a problem that providing the large machine room on the rooftop as in this conventional case will incur an extra cost for installation of the machine room. Moreover, the machine room provided on the rooftop of the building will make the building substantially higher by a height of the machine room. Therefore, it is another problem that the machine room will create a further shadow which will worsen sunshine on the building (especially on the north side).

SUMMARY OF THE INVENTION

In view of the above described problems, it is an object of the invention to provide such an elevator apparatus that the cost for installing the elevator can be kept low, and that the height of the building will not be largely increased.

In order to attain the above described object, there is provided, according to the invention, an elevator apparatus which comprises an actuating device including a sheave around which a rope engaged with an ascending and descending cage is wound, the sheave being adapted to rotate thereby to move the rope, and a driving section for rotating the sheave, and a shielding body for shielding the actuating device. The actuating device and the shielding body are installed on a rooftop of a building in which the ascending and descending cage is disposed.

According to the elevator apparatus of the invention, a height of the shielding body for covering the actuating device is so designed as to be lower than a height of an operator. Accordingly, the actuating device and the shielding body will not largely project from the rooftop of the building in which the ascending and descending cage is disposed, and a cost for the shielding body can be lowered.

The present disclosure relates to the subject matter contained in Japanese patent application No. Hei. 11-219488 (filed on Aug. 3, 1999), which is expressly incorporated herein by reference in its entirety.

DESCRIPTION OF THE PREFERRED EMBODIMENT

Figure 1:
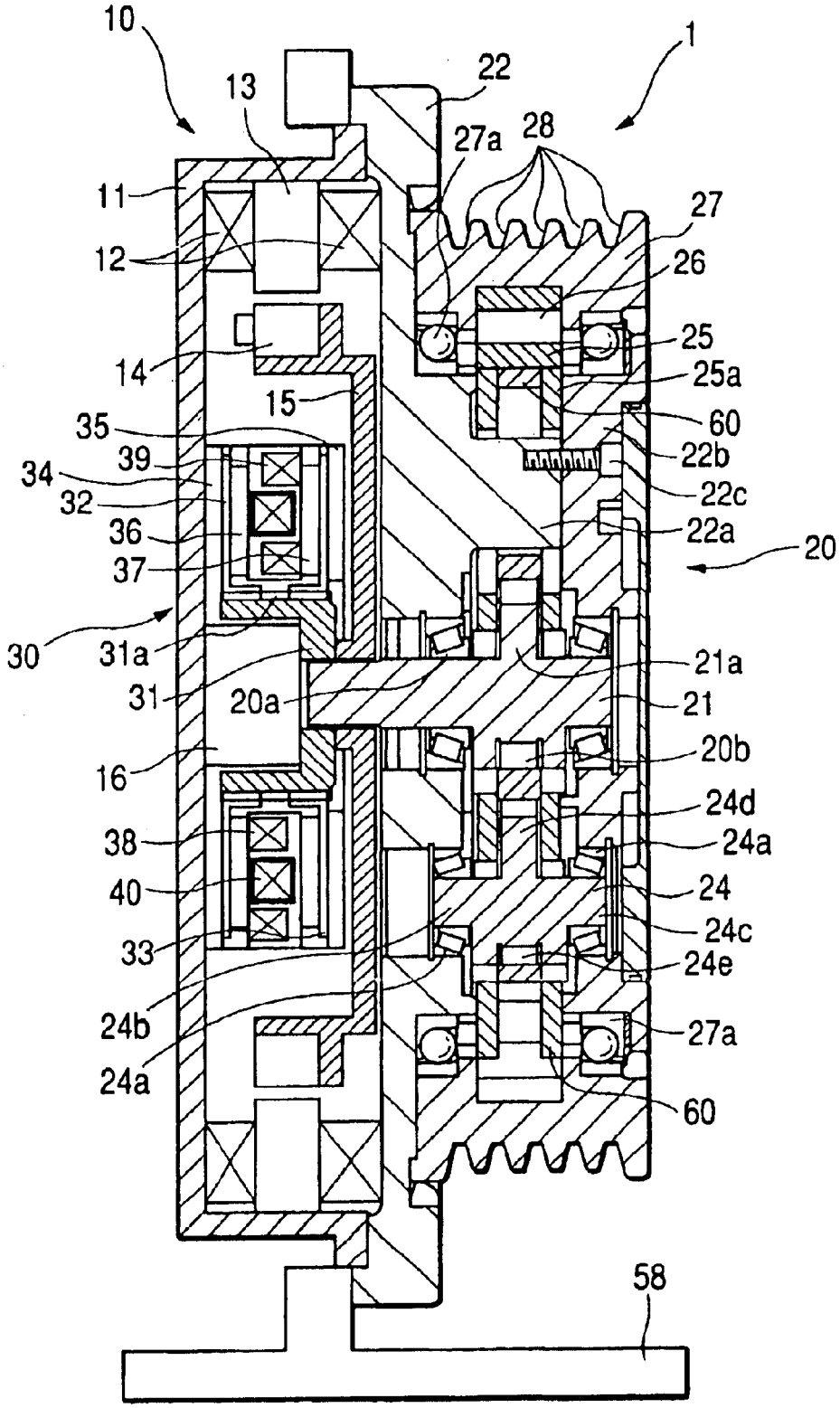
FIG. 1 is a sectional side view of an actuating device for an elevator illustrating an embodiment according to the invention.

Hereunder, a mode for carrying out the invention will be described referring to the drawings. FIG. 1 is a sectional side view of an actuating device 1 for an elevator illustrating an embodiment according to the invention.

As shown in FIG. 1, the actuating device 1 for the elevator includes a motor assembly 10, a speed-reducer 20 adapted to reduce rotation speed of an input shaft 21 which is driven to rotate by means of the motor assembly 10 to transmit the rotation, and a brake assembly 30.

The motor assembly 10 has, in a housing 11 of the motor assembly 10, a coil 12, a stator 13 disposed adjacent to the coil 12, a rotor 14, a rotary disc 15 fixed to the rotor 14 and having its center part splinedly connected to the input shaft 21 to rotate therewith, and an encoder 16 for detecting number of the rotation of the input shaft 21. The housing 11 is fixed to a support member 22 of the speed-reducer 20. The support member 22 is attached to an upper face of a rooftop 50 of a building which will be described later. The motor assembly 10 is so constructed that an electrical supply to the coil 12 is controlled by a control section which is not shown, whereby a determined amount of torque is outputted.

As shown in FIG. 1, the speed-reducer 20 includes the input shaft 21 which is rotatably supported by means of a bearing 20*a* at a center part of the support member 22 (a rotation center of the speed-reducer), a sheave 27 as an output rotary wheel which is rotatably supported by means of a pair of bearings 27*a* at an outer circumference of the support member 22, provided with grooves 28 on an outer periphery thereof to be wound by a rope 29 (FIG. 2), and provided with a determined number of internal teeth at an inner periphery thereof, a plurality of external teethed gears 60 which are engaged at their inner circumferences with a crank portion 21*a* of the input shaft 21 by means of bearings 20*b*, and each of which has a determined number of teeth on its outer circumference, and a plurality of support shafts 24 which are supported by the support member 22 at their opposite ends 24*b*, 24*c* by means of bearings 24*a*, and support a plurality of the external teethed gears 60 by means of bearings 24*e* at their crank portions 24*d*.

The internal teeth of the sheave 27 are constructed of a plurality of pins 26 and a plurality of cylindrical members 25 inserted into a plurality of the pins 26. The support member 22 is made up of one disc member having a plurality of posts 22*a* idly inserted into the external teethed gears 60, and the other disc member 22*b*. Both the disc members are connected to each other by means of a bolt 22*c*.

The sheave 27 rotates concentrically with the input shaft 21 with the reduced rotation transmitted from the input shaft 21. The rope 29 is connected to an ascending and descending cage 52 (FIG. 2) of the elevator and a balance weight 56 (FIG. 2) respectively in a manner described below, to move the ascending and descending cage 52 upward and downward.

The brake assembly 30 includes an intermediate member 31 in a cylindrical shape which is provided with an axial groove 31*a* on its outer circumference and splinedly coupled to the outer periphery of the input shaft 21, a pair of brake plates 32, 33 which are engaged with the axial groove 31*a* so as to be movable in an axial direction relative to the intermediate member 31 but rotatable integrally with the intermediate member 31, stationary walls 34, 35 which are arranged on opposite sides of the brake plates 32, 33 in an axial direction and held in a fixed state with respect to the housing 11, armatures 36, 37 disposed between the brake plates 32, 33 and movable to be drawn near or separated apart with respect to the stationary walls 34, 35, springs 38, 39 for respectively biasing the brake plates 32, 33 against the adjacent stationary walls 34, 35, and an electromagnet 40 fixedly arranged between the armatures 36, 37. A rotary portion of the encoder 16 is connected to the intermediate member 31, and a stationary portion of the encoder 16 is fixed to an inner wall of the housing 11.

Figure 2A:
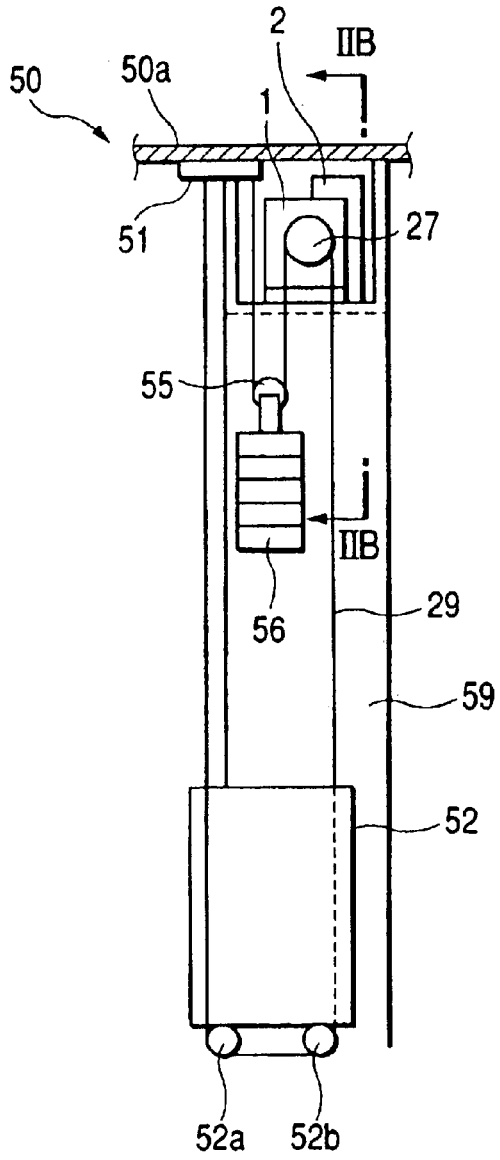
FIG. 2 is a view illustrating a state in which the actuating device 1 in FIG. 1 is disposed on a building.
Figure 2B:
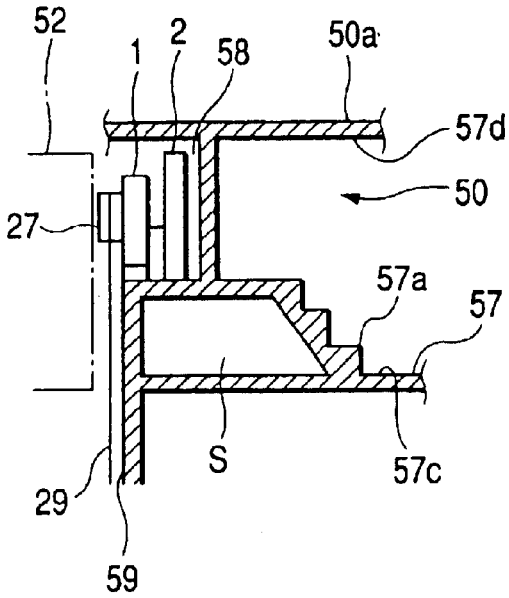

FIG. 2 is a view illustrating a state in which the actuating device 1 in FIG. 1 is disposed on the building. There is shown only a rooftop 50 of the building. Below the rooftop 50 of the building, is shown an ascending and descending cage 52 which is hung by means of the rope 29 and movable upward and downward along a guide which is not shown.

One end of the rope 29 is attached to a fitting portion 51 provided on a lower face of the rooftop 50. The rope 29 is wound around pulleys 52*a*, 52*b* provided on a lower face of the ascending and descending cage 52 to be directed upward, wound around the sheave 27 of the actuating device 1 to be directed downward, then, wound around a pulley 55 supporting the balance weight 56 to be directed upward, and finally attached to the fitting portion 51 at its other end.

As shown in FIG. 2, the actuating device 1 is covered with a case body 54 which is a shielding body so as to be protected from bad weather and direct sunlight. The case body 54 which is slightly larger than an outer shape of the actuating device 1 is set lower than a height of an operator S. Therefore, when the operator conducts a maintenance work of the actuating device 1, he need not enter into the case body 54, but he can work from outside opening a door (not shown) provided in the case body 54, or can detach the case body 54 from the rooftop 50 and expose the actuating device 1 to do the work. The control unit (not shown) for the actuating device 1 can be contained in the case body 54 in case where it is of a small size, or may be installed inside the building.

Next, drive and control of the ascending and descending cage 52 of the elevator by the actuating device 1 according to this embodiment will be described. At first, the motor assembly 10 in FIG. 1 is actuated by a signal from the control section (not shown) to rotate the input shaft 21 together with the rotor 14. Through the crank portion 21*a* of he input shaft 21, the external teethed gears 60 initiate eccentric swinging motions thus to cause the reduced rotation of the sheave 27 which has the internal teeth in mesh with the external teeth of the gears 60. Such reduction motion has been known. This rotation of the sheave 27 actuates the rope 29 which is wound in the grooves 28 on the outer periphery of the sheave, thereby to move the ascending and descending cage of the elevator upward and downward. The rotation of the input shaft 21 is reduced through the speed-reducer 20 at a determined ratio to be transmitted to the sheave 27, which rotates at a constant rotation speed.

During the operation of the motor assembly 10, electric power is supplied to the electromagnet 40 of the brake assembly 30, and the electromagnet 40 attracts the armatures 36, 37. When the armatures 36, 37 are attracted and move in a direction of approaching to each other, the springs 38, 39 are pushed by the armatures 36, 37 to contract. Thus, the brake plates 32, 33 are released from the biasing forces of the springs 38, 39 and separated from the stationary walls 34, 35 to put the intermediate member 31 in a rotatable condition, thereby maintaining a state in which the input shaft 21 is not applied with the braking force.

On the other hand, when the electric supply from the non-shown control unit is suspended (including a power failure), the electromagnet 40 will no more attract the armatures 36, 37. Therefore, the brake plates 32, 33 are pressed against the stationary walls 34, 35 with strong biasing forces of the springs 38, 39 through the armatures 36, 37. On this occasion, since large friction forces are exerted between the stationary walls 34, 35 and the brake plates 32, 33, a braking force can be applied to the input shaft 21 through the intermediate member 31 based on these friction forces. This causes the sheave 27 to stop the rotation.

Because the output rotary wheel itself of the speed-reducer 20 constitutes the sheave 27 around which the rope 29 is wound, and at the same time, both the motor assembly 10 and the brake assembly 30 are provided on a same plane which is at right angle with the input shaft 21, this actuating device can be designed to be thin in an axial direction of the input shaft 21 as compared with the conventional actuating device. When the actuating device 1 capable of being designed to be thin and compact in this way is installed on the rooftop 50 of the building, there is no need of providing the large-sized machine room as in the conventional case, but the small case body 54 to cover the actuating device will be sufficient. Therefore, the cost for installing the elevator will become low. Further, the case body 54 will not largely project from the rooftop 50 of the building, and therefore, a favorable sunshine on the building (especially on the north side) can be maintained. Moreover, because the actuating device 1 can be installed outdoors by overcoming the above described problems, such sound proofing measures that would be particularity required in case where the actuating device is disposed indoors can be omitted or less accommodated. This can contribute to reduction of the cost.

Although the invention has been described referring to the embodiment hereinabove, the invention is not limited to the embodiment, but various modifications are possible within a scope of technical concept of the invention. For example, a window for ventilation purpose or a forced cooling fan, etc. may be provided in the case body, considering that the case body may keep heat from the actuating device due to its relatively compact design. Further, the structure as shown in this embodiment is simply one example of the actuating devices. As far as the device can be installed in a case body which is smaller than a height of an operator, the device is not limited to the structure as shown in the described embodiment.

According to the elevator apparatus of the invention, the height of the shielding body for covering the actuating device is so designed as to be lower than the height of the operator. Accordingly, the actuating device and the shielding body will not largely project from the rooftop of the building in which the ascending and descending cage is disposed, and the cost for the shielding body can be lowered.

What is claimed is:

1. An elevator apparatus comprising:

an actuating device including a sheave around which a rope engaged with an ascending and descending cage is wound, said sheave being adapted to rotate thereby to move said rope with its rotation, and a motor assembly for rotating said sheave, and a disc member having a plurality of posts to which external teeth gears of a speed reducer are idly mounted, said disc member serving as a side wall of a housing of said motor assembly; and a shielding body for shielding said actuating device, wherein:

said sheave, said speed reducer, said motor assembly and a brake assembly are integrated in said actuating device;

said speed reducer and said motor assembly are arranged coaxially to one another;

an output wheel of said speed reducer constitutes said sheave, so that said speed reducer is arranged radially inwardly of said sheave; and said actuating device and said shielding body are installed on a rooftop of a building in which said ascending and descending cage is disposed, said shielding body being readily detachable from said rooftop.

2. The elevator apparatus according to claim 1 wherein said motor assembly comprises a motor having an axis of rotation, wherein said brake assembly overlaps with the motor in a plane normal to the axis of rotation.

3. The elevator apparatus according to claim 1, wherein the plurality of posts are located on a first side of the disc member and a second side of the disc member constitutes an inner face of the housing of the motor assembly.

4. The elevator apparatus according to claim 1, wherein the shielding body is slightly larger than an outer shape of the actuating device.

5. The elevator apparatus according to claim 1, wherein the shielding body is sufficiently compact, accessible and light weight as to be readily detached from said rooftop when an operator conducts maintenance work on the actuating device.

6. The elevator apparatus according to claim 1, wherein an installation area of the actuating device is smaller than a cross sectional area of the cage.

* * * * *